US007429218B2

(12) United States Patent
Pinder

(10) Patent No.: US 7,429,218 B2
(45) Date of Patent: Sep. 30, 2008

(54) GOLF CLUB HAVING AN ADJUSTABLE SHAFT ANGLE

(76) Inventor: Bernard Pinder, P. O. Box 231, Grand Haven, MI (US) 49417

( * ) Notice: Subject to any disclaimer, the term of this patent is extended or adjusted under 35 U.S.C. 154(b) by 295 days.

(21) Appl. No.: 11/220,124

(22) Filed: Sep. 6, 2005

(65) Prior Publication Data

US 2007/0054747 A1 Mar. 8, 2007

(51) Int. Cl.
*A63B 69/36* (2006.01)
*A63B 53/02* (2006.01)
*A63B 53/06* (2006.01)

(52) U.S. Cl. ..... 473/244; 473/246; 473/248

(58) Field of Classification Search ..... 473/244–248, 473/305–315; 403/83–108
See application file for complete search history.

(56) References Cited

U.S. PATENT DOCUMENTS 1,352,020 A * 9/1920 Olson ..... 473/246
1,657,972 A * 1/1928 Rowe ..... 473/248
2,155,830 A * 4/1939 Howard ..... 473/246
4,735,414 A * 4/1988 Williams et al. ..... 473/248
4,815,740 A * 3/1989 Williams et al. ..... 473/248
5,253,869 A * 10/1993 Dingle et al. ..... 473/245
5,308,063 A * 5/1994 Vendur ..... 473/248
5,390,919 A * 2/1995 Stubbs et al. ..... 473/246
5,716,287 A * 2/1998 Levocz et al. ..... 473/248
6,435,976 B1 * 8/2002 Galliers ..... 473/244

* cited by examiner

*Primary Examiner*—Sebastiano Passaniti
(74) *Attorney, Agent, or Firm*—Watson IP group, PLC; Jovan N. Jovanovic; Vladan M. Vasiljevic

(57) ABSTRACT

A golf cub comprising a head, a shaft assembly and a shaft attachment assembly. The head includes a body which includes a face and a back. The shaft assembly includes a shaft member. The shaft attachment assembly includes a primary plug assembly. The primary plug assembly includes a primary plug to which the shaft member is attached, and, a member which facilitates rotatably positioning of the primary plug relative to the back of the head, to, in turn, vary the angle of the shaft member relative to the back of the head.

8 Claims, 8 Drawing Sheets

GOLF CLUB HAVING AN ADJUSTABLE SHAFT ANGLE

BACKGROUND OF THE INVENTION

1. Field of the Invention

The invention is directed primarily to the sport of golf, and, more particularly to golf clubs associated with the sport. The particular club disclosed and claimed pertains to one that has an adjustable shaft angle such that the golf club can be adjusted and tuned for a particular user. The invention is shown primarily with respect to putters, however, the principles of the invention may be applied to other clubs.

2. Background Art

Golf clubs, and, in particular, putters have long been known in the art. Countless designs for golf clubs have been developed to provide certain advantages. Among other features, it has been found that a proper fitting club is highly advantageous to a golfer. Inasmuch as different players have different heights, arm lengths, postures, etc., to provide a custom club, a user must have access to machinery or a large number of different configurations (i.e., a large inventory).

It would be highly advantageous if a club had a range of adjustment so that a single club could be modified (i.e., adjusted) to a number of different orientations. In turn, a single set of components could be suitable for a number of differently shaped and sized golfers. As a result, the quantity of specialized parts and the inventory that would be maintained by a golf club fitter could be greatly reduced.

It is therefore an object of the invention to provide a golf club which includes components which permit a certain amount of adjustment, to, in turn, provide a perfect fit for a number of golfers having differing measurements.

It is another object of the invention to provide a custom golf club fit with components that fit a wide variety of users of different measurements.

These and other objects of the present invention will become apparent in light of the present specification, claims, and drawings.

SUMMARY OF THE INVENTION

The invention comprises a golf club. The golf club includes a head, a shaft assembly and a shaft attachment assembly. The head includes a body which has a face and a back. The shaft assembly includes a shaft member. The shaft attachment assembly comprises a primary plug assembly. The primary plug assembly includes a primary plug and means for rotatably positioning the primary plug relative to the back of the head. The shaft member is attached to the primary plug.

In a preferred embodiment, the rotatably positioning means comprises a pair of opposing slots and means for fastening the primary plug to the head. The pair of opposing slots are of an arcuate configuration extending through the primary plug. The fastening means comprises a pair of screws extendable through the opposing slots and into corresponding threaded openings in the back of the head. The pair of screws are each slidably positionable within the respective slot of the pair of opposing slots.

In one such preferred embodiment, the shaft member defines a longitudinal axis. The longitudinal axis of the shaft member extends between the opposing slots in a manner in which the opposing slots are mirror images of each other about the longitudinal axis.

In one such embodiment, the pair of opposing slots have an angular length of approximately 90°.

In a preferred embodiment, the rotatably positioning means comprises at least one slot, at least one pin and a fastening means. The at least one slot is of arcuate configuration disposed on the primary plug. The at least one pin is fixed to the back of the head which is inserted into the slot. The fastening means fastens the primary plug to the back of the head. The fastening means comprises a fastener extending through the primary plug into the back of the head. The at least one plug rotates about the fastener while the at least one pin travels along the at least one slot.

In another preferred embodiment, the primary plug has a substantially circular cross-section, defining a cross-section center. Similarly, the pair of opposing slots defining a slot center. In the preferred embodiment, the cross-section center and the slot center substantially correspond.

In yet another preferred embodiment, the back of the head further includes an attachment assembly receiver disposed in the back of the head.

Preferably, the primary plug comprises a substantially circular cross-section, defining a cross-section center, wherein the cross-section center substantially corresponds to a centerline of the club face.

In another preferred embodiment, the golf club further comprises a secondary plug attachable to one of the primary plug and the back of the head.

In another preferred embodiment, the shaft assembly further comprises a hosel, a shaft member and a grip member. The hosel includes a shaft member attachment structure and a primary plug attachment structure. The shaft member is attached to the shaft member attachment structure. The grip member is attached to the shaft member.

In another aspect of the invention, the invention comprises a golf club comprising a head, a primary plug assembly, a shaft assembly and means for rotationally positioning the primary plug relative to the head. The head has a body defining a face and a back. The primary plug is attached to the back of the body of the head. The shaft assembly includes a shaft member attached to the primary plug and the rotational positioning means facilitates the adjustment of the angle of the shaft member of the shaft assembly relative to the head.

In a preferred embodiment, the head includes a centerline. The primary plug is positioned proximate the centerline of the head.

In one such embodiment, the rotationally positioning means comprises a pair of opposing slots and a pair of screws. The pair of opposing slots extend through the primary plug. The pair of screws extend through the pair of opposing slots and into corresponding openings positioned in the back of the head. The pair of screws are capable of slidable movement along the pair of opposing slots, to, in turn, allow for the rotation of the primary plug relative to the head.

In a preferred embodiment, the rotatably positioning means comprises at least one slot, at least one pin and a fastening means. The at least one slot is of arcuate configuration disposed on the primary plug. The at least one pin is fixed to the back of the head which is inserted into the slot. The fastening means fastens the primary plug to the back of the head. The fastening means comprises a fastener extending through the primary plug into the back of the head. The at least one plug rotates about the fastener while the at least one pin travels along the at least one slot.

In a preferred embodiment, the golf club further comprises a secondary plug attachable to one of the primary plug and the back of the head. The secondary plug enhances weight and weight distribution of the golf club.

In another preferred embodiment, the primary plug includes a hosel attachment member. The shaft assembly further comprising a hosel attached to the shaft member. The hosel having a primary plug attachment structure insertable into the hosel attachment member of the primary plug.

In one such embodiment, the hosel attachment member defines a longitudinal axis. The primary plug includes a longitudinal axis. The longitudinal axis of the hosel attachment member and the longitudinal axis of the primary plug intersect in a substantially perpendicular orientation.

In another preferred embodiment, the primary plug further includes a secondary plug attachment member. Additionally, the golf club further includes a secondary plug assembly including a secondary plug having a bore extending through the longitudinal axis thereof and substantially corresponding to the secondary plug attachment member of the primary plug, and a fastener extending through the bore of the secondary plug and attached to the secondary plug attachment member of the primary plug.

In yet another embodiment, the invention comprises a golf club. The golf club includes a head, a shaft assembly and a shaft attachment assembly. The head includes a body defining a face, a back and a sole. The shaft assembly includes a shaft member, a hosel attached to a first end and a grip associated with the second end. The shaft attachment assembly comprising a primary plug assembly and a secondary plug assembly. The primary plug assembly comprising a primary plug and means for rotationally positioning the primary plug relative to the head. The primary plug has a body with a first end and a second end, a hosel attachment member extending into the body into which the hosel is positioned. The rotatably positioning means comprises at least one slot, at least one pin and a fastening means. The at least one slot is of arcuate configuration disposed on the primary plug. The at least one pin is fixed to the back of the head which is inserted into the slot. The fastening means fastens the primary plug to the back of the head. The fastening means comprises a fastener extending through the primary plug into the back of the head. The at least one plug rotates about the fastener while the at least one pin travels along the at least one slot. The secondary plug assembly includes a secondary plug having a bore extending therethrough and a fastener extending through the bore and coupled to at least one of the primary plug and the head.

BRIEF DESCRIPTION OF THE DRAWINGS

The invention will now be described with reference to the drawings wherein.

DETAILED DESCRIPTION OF THE INVENTION

Figure 1:
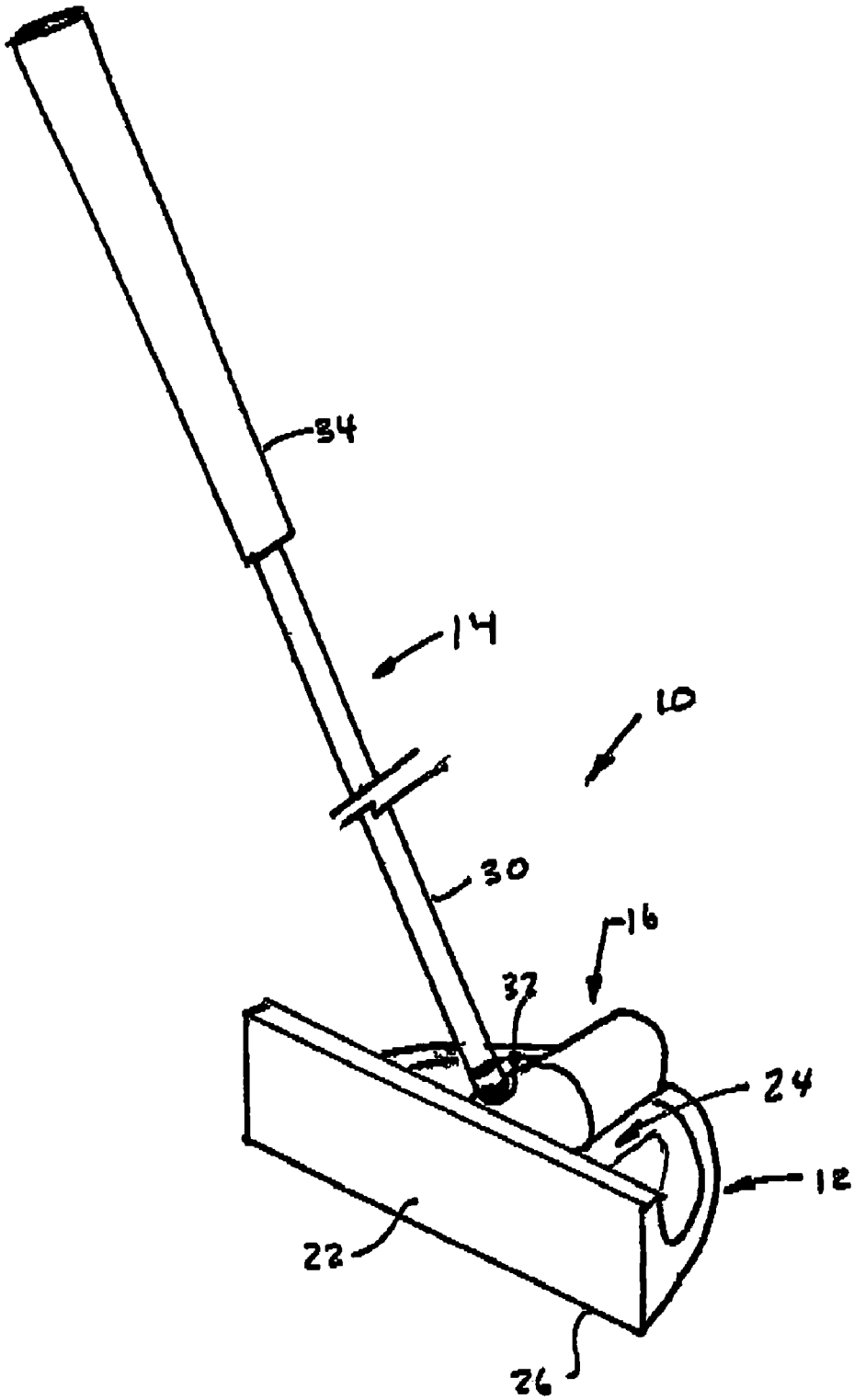
FIG. 1 of the drawings comprises a perspective view of the golf club of the present invention.

While this invention is susceptible of embodiment in many different forms, there is shown in the drawings and described herein in detail a specific embodiment with the understanding that the present disclosure is to be considered as an exemplification of the principles of the invention and is not intended to limit the invention to the embodiment illustrated.

It will be understood that like or analogous elements and/or components, referred to herein, may be identified throughout the drawings by like reference characters. In addition, it will be understood that the drawings are merely schematic representations of the invention, and some of the components may have been distorted from actual scale for purposes of pictorial clarity.

Referring now to the drawings and in particular to FIG. 1, the golf club of the present invention is shown at 10. Golf club 10 includes head 12, shaft assembly 14 and shaft attachment assembly 16. The golf club shown in the present invention is generally utilized as a putter. It will be understood that some of the principles of the invention may be suited for use in association with other clubs, such as a chipper, certain wedges or specialty clubs, to name a few.

Figure 2:
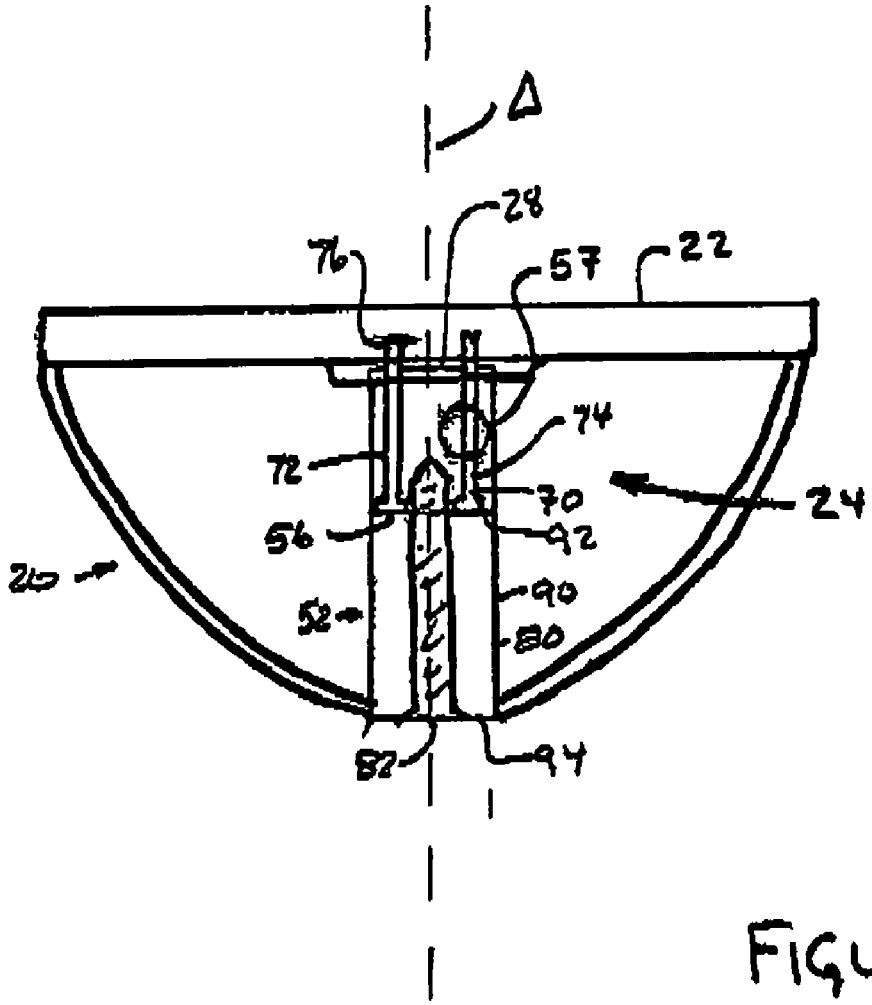
FIG. 2 of the drawings comprises a top plan view of the golf club of the present invention, with the shaft assembly removed.
Figure 4:
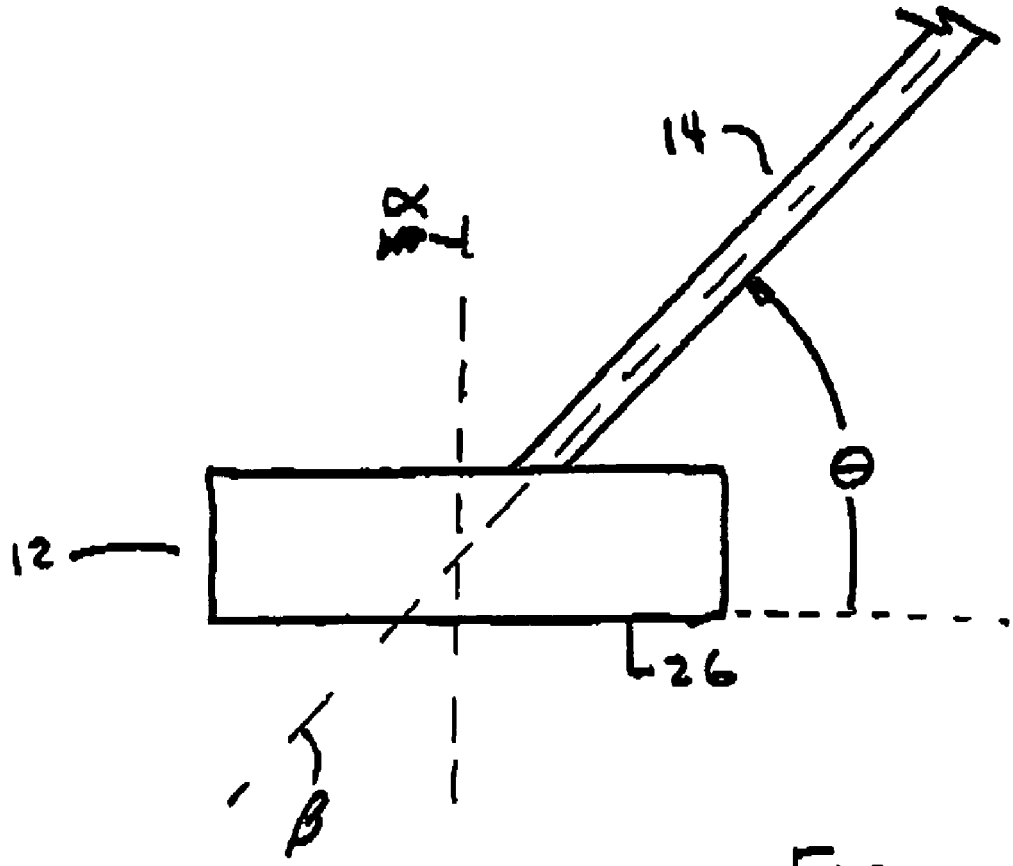
FIG. 4 of the drawings comprises a front plan view of the golf club of the present invention, showing in particular, the various longitudinal axes of same.

Head 12 is shown in FIG. 2 as including body 20 having face 22, back 24 and sole 26 (FIG. 1). In the present embodiment, the back of body 20 comprises a substantially semicircular configuration. Immediately behind face 22, preferably, centered about the head centerline, denoted by $\alpha$ in FIG. 4, attachment assembly receiver 28 is positioned on back 24. Body 20 may comprise any number of different materials, such as, for example, aluminum, brass, steel, wood, or various composites. Indeed, it is not limited to any particular material. Moreover, it is contemplated that body 20 may comprise any one of a number of different configurations. For example, body 20 may incorporate certain of the features disclosed in U.S. patent application Ser. No. 10/853,613, entitled "Golf Club Putter and Aid," the entire specification of which is incorporated by reference.

Shaft Assembly 14 is shown in FIG. 1 as comprising shaft member 30, hosel 32 and grip 34. It will be understood that shaft member 30 may comprise any one of a number of different shaft materials, including, but not limited to metal shafts and composite shafts. Additionally, grip 34 may comprise any one of a number of different grip structures, both those approved and unapproved by the USGA. The invention is not limited to any particular configuration of the shaft member and the grip.

Figure 3:
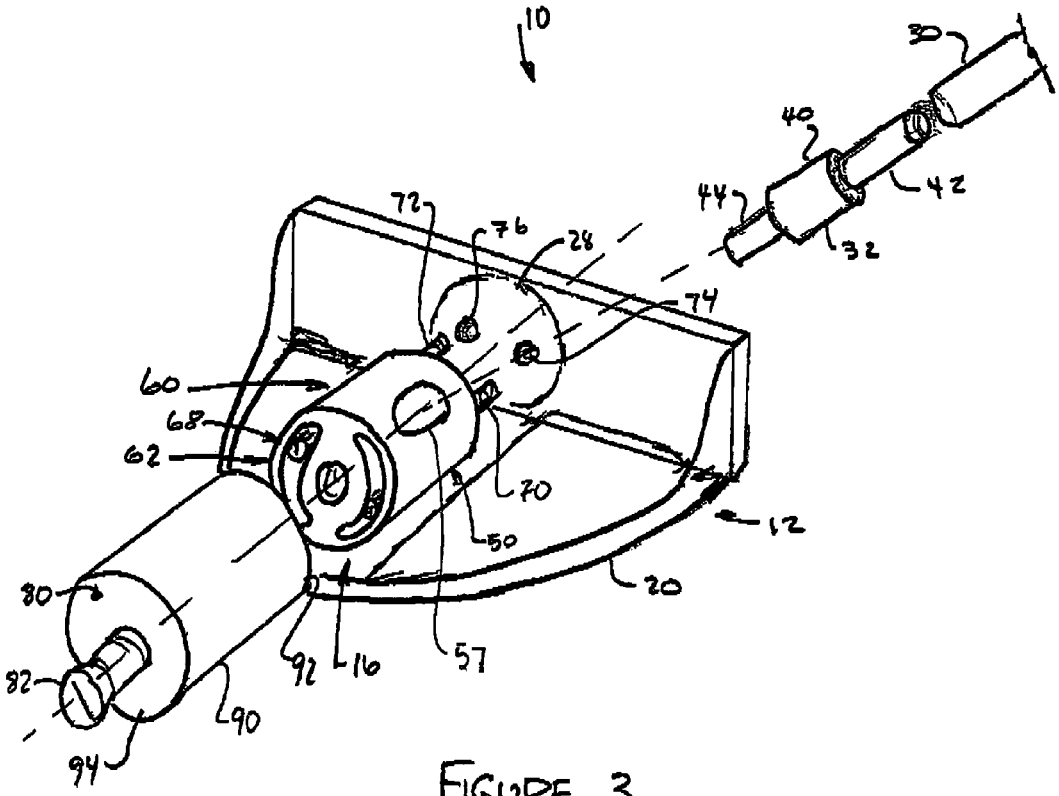
FIG. 3 of the drawings comprises an exploded perspective view of the golf club of the present invention.
Figure 8:
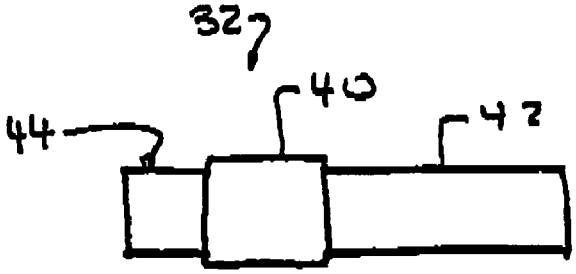
FIG. 8 of the drawings comprises a side elevational view of the hosel of the golf club of the present invention.
Figure 9:
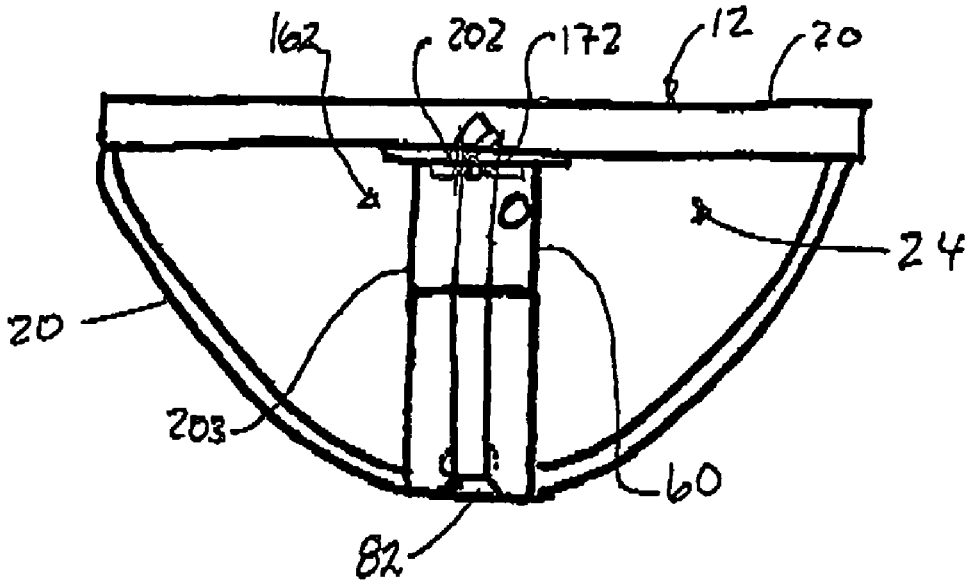
FIG. 9 of the drawings comprises a top plan view of another embodiment of the golf club of the present invention, with the shaft assembly removed.
Figure 10:
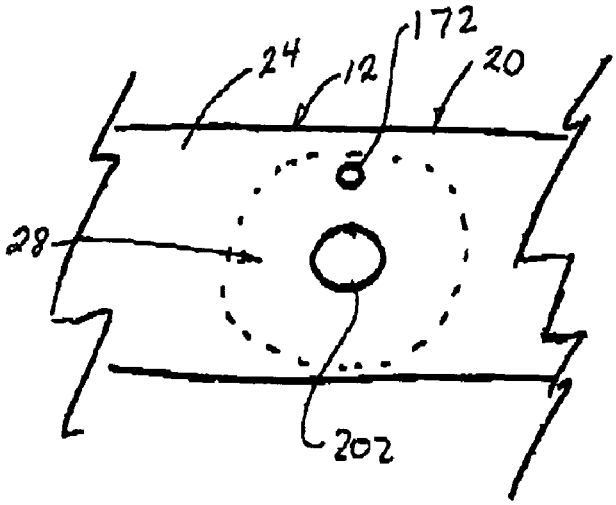
FIG. 10 of the drawings comprises a partial back plan view of the golf club of the present invention.
Figure 11:
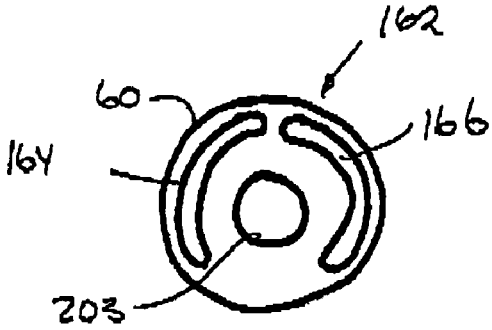
FIG. 11 of the drawings comprises a front plan view of the primary plug of the golf club of the present invention.
Figure 12:
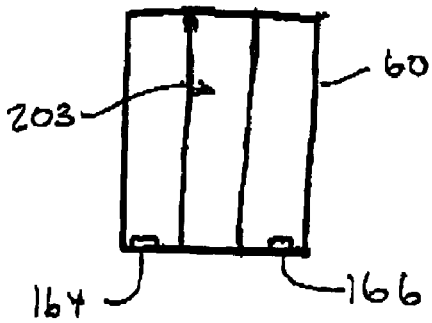
FIG. 12 of the drawings comprises a cross-sectional view of the primary plug of the golf club of the present invention.

Hosel 32 is shown in FIG. 8 as comprising central body 40, flanked by shaft member attachment structure 42 on a first side, and primary plug attachment structure 44 on a second side. With reference to FIG. 3, shaft member 30 slides over the shaft member attachment structure 42 so as to be coupled thereto. As will be explained below, primary plug attachment structure 44 is insertable into hosel attachment member 57 of the primary plug 60 of shaft attachment assembly 16.

Figure 6:
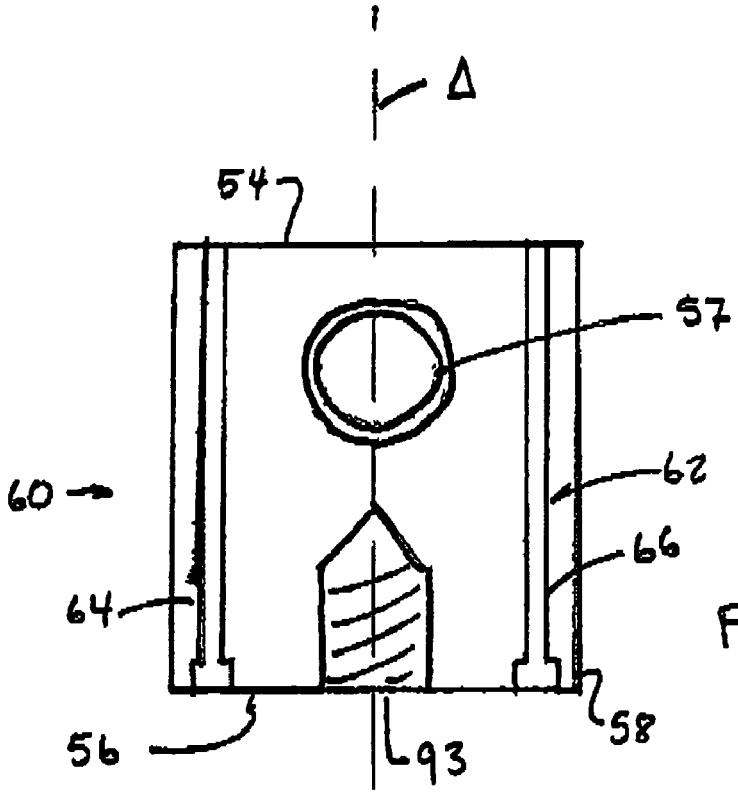
FIG. 6 of the drawings comprises a cross-sectional view of the primary plug of the golf club of the present invention, taken generally about lines 6-6 of FIG. 5.
Figure 5:
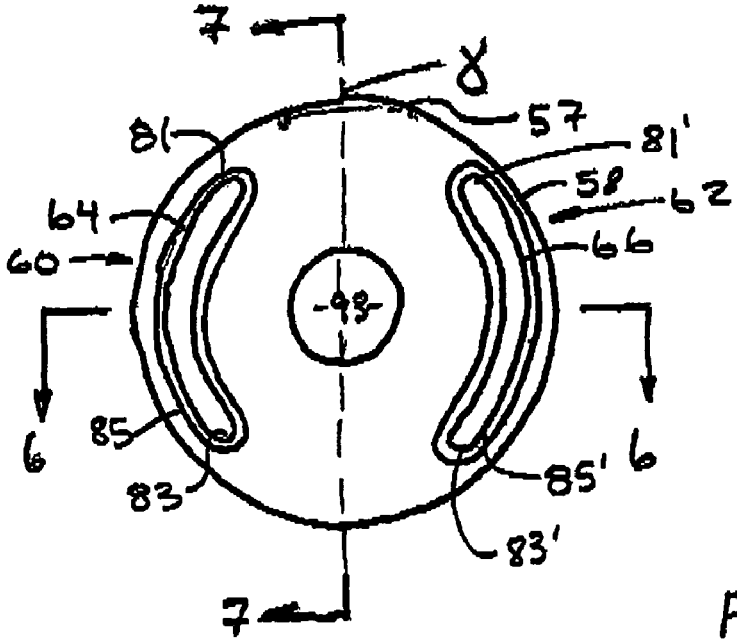
FIG. 5 of the drawings comprises a front plan view of the primary plug of the golf club of the present invention.
Figure 7:
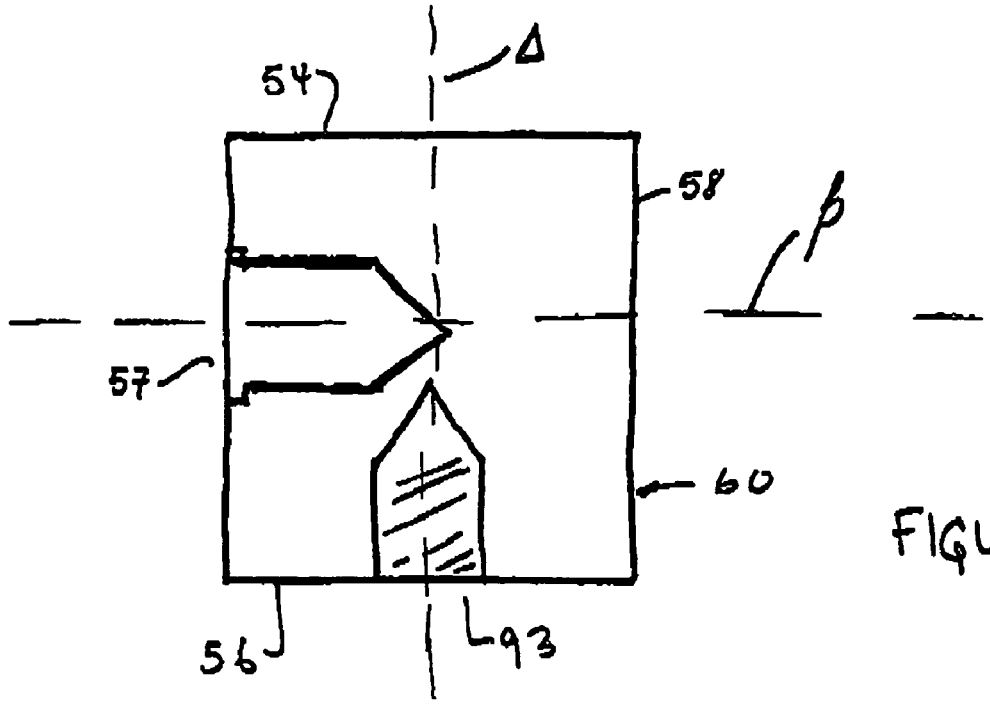
FIG. 7 of the drawings comprises a cross-sectional view of the primary plug of the golf club of the present invention, taken generally about lines 7-7 of FIG. 5.

Shaft attachment assembly 16 is shown in FIG. 3 as comprising primary plug assembly 50 and secondary plug assembly 52. Primary plug assembly 50 includes primary plug 60 and means 62 for rotationally positioning the plug relative to head 12. With reference to FIGS. 5 through 7, collectively primary plug 60 includes body 58 having a first end 54 and a second end 56. Hosel attachment member 57 comprises a bore that extends into body 58 between the first and second end thereof. In the embodiment shown, primary plug 60 comprises a substantially uniform cylindrical member. The hosel attachment member is substantially perpendicular to a tangent of the surface of the cylinder, such that the axis, denoted by β in FIG. 7, of the hosel attachment member 57 extends through the center of the cylinder (i.e., intersects with cross-section axis, denoted by Δ). In other embodiments, the hosel attachment member may be offset such that the axis of the hosel attachment member is offset from the central axis of the primary plug 60. The primary plug 60 further includes a second plug attachment bore 93 positioned in second end 56 of body 58 of primary plug 60.

Rotational positioning means 62 is shown in FIGS. 5 and 6 as comprising opposing slots 64, 66 and means 68 for fastening the primary plug to body 20 of head 12 (FIG. 3). The slots are substantially mirror images of each other centered about an axis (denoted by γ in FIG. 5) that extends through the center of the primary plug. Inasmuch as the two slots are substantially mirror images of each other, opposing slot 64 will be described with the understanding that opposing slot 66 is substantially identical. Similar corresponding structures of the opposing slot will have the same reference numbers augmented with a prime (').

With reference with FIG. 5, opposing slot 64 extends from a first end 81 to a second end 83. The slot generally has a radius of curvature that is concentric with the outer surface of the primary plug and set apart from the surface of a predetermined distance. Furthermore, opposing slot 64 includes a countersink 85 extending about the outer perimeter thereof.

Referring again to FIG. 3, fastening means 68 includes a pair of screws 70, 72 which are extendable through opposing slots 64, 66 and into corresponding openings 74, 76 in back 24 of body 20, upon positioning of the primary plug into the attachment assembly receiver 28 of head 12. As is shown in FIG. 5, the heads of the screws fall into the countersinks 85, 85' of the opposing slots 64, 66, respectively.

With reference to FIG. 3, secondary plug assembly 52 includes secondary plug 80 and fastener 82. Secondary plug 80 includes body 90, first end 92 and second end 94. Body 90 is configured so as to be substantially cylindrical and corresponding in diameter with primary plug 60. Body 90 includes a bore that extends therethrough along the central axis of the secondary plug and substantially corresponds to the secondary plug bore of the primary plug 60.

The length, the cross-section configuration and the material from which the plugs are formed may be varied so as to adjust the weight and weight distribution of the resulting club. For example, it is contemplated that the primary plug has a diameter of 0.75", a length of 0.8" and that it is formed from a brass alloy. It is contemplated that the secondary plug comprises a diameter of 0.75", a length of about 1.575" and that it is formed from aluminum or an alloy thereof. Of course, each of the dimensions may be varied, and the materials selected may be varied so as to achieve different weight and weight distributions.

In operation, the club is first assembled for a particular user and customized such that the angle between the head and the shaft assembly (denoted by θ in FIG. 4) can be properly set for the user. Once set, the assembly can be completed. Advantageously, a single set of components may be adapted and oriented to fit any number of different users, thereby limiting the number of specialized components required by one fitting a golf club to a number of physically different individuals.

Specifically, a fitting specialist, or other individuals familiar with proper club orientation and positioning (an assembler) first gathers the various components of the golf club. First, head 12 is selected. Once selected primary plug 60 is positioned such that the first end enters into the attachment assembly receiver on the back of the club head. Once positioned, screws 70, 72 are extended through the respective opposing slots 64, 66 and inserted into corresponding openings 74, 76.

Screws 70, 72 are initially loosely fastened so as to permit rotation of the head relative to primary plug 60 and slidable movement of the screws 70, 72 along the opposing slots 64, 66. It will be understood that as the primary plug 60 is rotated about head 12, the hosel attachment member 57 changes position relative to the head. This, in turn, adjusts the angle between the shaft member and the club head. The range of angles available to the adjuster is limited by the length of opposing slots 64, 66. In the present embodiment, the slots generally have an angular length of about 90°, or a quarter of the rotation of the primary plug. In other embodiments, the length of the slots can be varied so as to achieve different ranges of adjustment.

Once the desired angle between the hosel attachment member 57 and head 12 is achieved (which can be done from empirical data, or a custom fitting for any particular user), the screws 70, 72 are tightened so as to securely couple primary plug 60 to head 12. Indeed, certain thread fasteners may be employed so as to substantially preclude the inadvertent loosening of the fasteners. Of course, certain locking threadforms may be employed as well.

After the desired relative positioning is reached, secondary plug assembly 52 is positioned such that the first end of the secondary plug 80 abuts the second end of the primary plug, and, such that the bore of the secondary plug assembly substantially corresponds with the secondary plug bore positioned on the primary plug. Once in a proper orientation, fastener 82 is inserted through the bore of the secondary plug assembly and into the secondary plug bore of the primary plug. The secondary plug assembly further enhances the weight distribution of the golf club.

Once the plugs are positioned as desired, hosel 32 is attached to the primary plug. In certain embodiments, the hosel can be attached to the primary plug before the primary plug is attached to head 12. To attach the hosel, the primary plug attachment structure 44 of hosel 32 is inserted into hosel attachment member 57 of the primary plug 60. To retain the attached configuration, the hosel may be adhered, soldered, welded together. In other embodiments, a mechanical retention through an interference fit may be enough to maintain the attached configuration. In still other embodiments, the hosel and the bore may be threaded wherein the attachment is accomplished by threading the hosel into the primary plug.

Once the hosel is attached, the shaft member is completed and the grip is coupled to the shaft member. Specifically, the shaft member is slid over the shaft member attachment structure 42 of hosel 32. This may be accomplished by any of the coupling structures identified above with respect to the coupling of the hosel to the primary plug.

Once complete, the club is ready for use. Advantageously, the same components can be adjusted to fit any number of different users, each of which may vary in height, and arm length, among other features.

In another embodiment, shown in FIGS. 9 through 12, a modified rotational positioning means 162 is shown. In such an embodiment, the opposing slots 164, 166 extend only partially into primary plug 60. These slots interface with pin 172 which is fixedly attached to the back 24 of body 20 of head 12. With such an embodiment, pin 172 interacts with one of the two slots when the club is configured for a right handed user, and with the other of the two slots when the club is configured for a left handed user. It is contemplated that two or more pins may be utilized, or that the slots may have a different configuration. In certain embodiments, a single pin may be utilized with a sot member on opposing ends (wherein the plug member is attached in one manner for a right handed player and in an opposite manner for a left handed player.

In the embodiment shown, the pin member is located directly above opening 202 through which fastener 82 is extended. In such an embodiment, fastener 82 extends through opening 203 in primary plug 60 and is utilized to lock primary plug 60 to the body once the desired rotative position is achieved. In such an embodiment, the secondary plug may include a set screw which extends through head 12 and interferes with the secondary plug so as to preclude rotation of the secondary plug during use. Such an embodiment achieves rotational positioning of the club head vis-à-vis the handle while utilizing fewer components.

It is contemplated that the slots may be reconfigured so as to comprise a single slot, however, the configuration shown limits the angle of the handle relative to the club head to less than 80° (which is a current USGA regulation).

The operation of the embodiment of is quite similar to that of the first embodiment with the exception that the rotation of the primary plug can be achieved merely by loosening fastener 82 and rotating the primary plug relative to the club head about fastener 82 with the rotation controlled by the interaction of pin 172 with one of slots 164, 166.

The foregoing description merely explains and illustrates the invention and the invention is not limited thereto except insofar as the appended claims are so limited, as those skilled in the art who have the disclosure before them will be able to make modifications without departing from the scope of the invention.

What is claimed is:

1. A golf club comprising:

a head having a body defining a face and a back;

a primary plug attached to the back of the body of the head;

a shaft assembly including a shaft member attached to the primary plug;

means for rotationally positioning the primary plug relative to the head, to, in turn, adjust the angle of the shaft member of the shaft assembly relative to the head, wherein the rotational positioning means comprises:

a pair of opposing slots extending through the primary plug; and a pair of screws extending through the pair of opposing slots and into corresponding openings positioned in the back of the head, the pair of screws capable of slidable movement along the pair of opposing slots, to, in turn, allow for the rotation of the primary plug relative to the head; and a secondary plug extending from the back of the primary plug, opposite of the head, and attachable to one of the primary plug and the back of the head, to, in turn, enhance weight and weight distribution of the golf club.

2. The golf club of claim 1 wherein the head includes a centerline, the primary plug positioned proximate the centerline of the head.

3. The golf club of claim 1 wherein the primary plug includes a hosel attachment member, the shaft assembly further comprising:

a hosel attached to the shaft member, the hosel having a primary plug attachment structure insertable into the hosel attachment member of the primary plug.

4. The golf club of claim 3 wherein the hosel attachment member defines a longitudinal axis, the primary plug having a longitudinal axis, the longitudinal axis of the hosel attachment member and the longitudinal axis of the primary plug intersecting in a substantially perpendicular orientation.

5. A golf club comprising:

a head having a body defining a face and a back;

a primary plug attached to the back of the body of the head;

a shaft assembly including a shaft member attached to the primary plug; and means for rotationally positioning the primary plug relative to the head, to, in turn, adjust the angle of the shaft member of the shaft assembly relative to the head, wherein the rotational positioning means comprises:

at least one slot of arcuate configuration disposed on the primary plug;

at least one pin fixed to the back of the head which is inserted into the slot; and means for fastening the primary plug to the back of the head wherein the fastening means comprises a fastener extending through the primary plug into the back of the head wherein the at least one plug rotates about the fastener while the at least one pin travels along the at least one slot, wherein the primary plug further includes a secondary plug attachment member and further comprises a secondary plug assembly including a secondary plug having a bore extending through the longitudinal axis thereof and substantially corresponding to the secondary plug attachment member of the primary plug, and a fastener extending through the bore of the secondary plug and attached to the secondary plug attachment member of the primary plug.

6. The golf club of claim 5 wherein the primary plug includes a hosel attachment member, the shaft assembly further comprising:

a hosel attached to the shaft member, the hosel having a primary plug attachment structure insertable into the hosel attachment member of the primary plug.

7. The golf club of claim 6 wherein the hosel attachment member defines a longitudinal axis, the primary plug having a longitudinal axis, the longitudinal axis of the hosel attachment member and the longitudinal axis of the primary plug intersecting in a substantially perpendicular orientation.

8. A golf club comprising:

a head including a body defining a face, a back and a sole;

a shaft assembly including a shaft member, a hosel attached to a first end and a grip associated with the second end;

a shaft attachment assembly comprising:

a primary plug assembly including:

a primary plug having a body with a first end and a second end, a hosel attachment member extending into the body into which the hosel is positioned; and means for rotationally positioning the primary plug relative to the head, the rotational positioning means comprising:

at least one slot of arcuate configuration disposed on the primary plug at least one pin fixed to the back of the head which is inserted into the slot; and means for fastening the primary plug to the back of the head wherein the fastening means comprises a fastener extending through the primary plug into the back of the head wherein the at least one plug rotates about the fastener while the at least one pin travels along the at least one slot; and a secondary plug assembly including:

a secondary plug, positioned behind the primary plug, having a bore extending therethrough; and a fastener extending through the bore and coupled to at least one of the primary plug and the head.

* * * * *